United States Patent [19]

Eisenberg

[11] 4,308,634

[45] Jan. 5, 1982

[54] BRUSH BRISTLE CLEANING SYSTEM

[76] Inventor: Abraham Eisenberg, 6604 Chippewa Dr., Baltimore, Md. 21209

[21] Appl. No.: 170,090

[22] Filed: Jul. 18, 1980

[51] Int. Cl.[3] ..... A46B 17/06

[52] U.S. Cl. ..... 15/142; 15/104 R; 15/104.92

[58] Field of Search ..... 15/1, 38, 104 R, 104.92, 15/104.5, 142, 141 R, 257 R; 366/129, 342, 343; 119/83, 86, 89

[56] References Cited

U.S. PATENT DOCUMENTS

| | | | |
|---|---|---|---|
| 678,586 | 7/1901 | Preston et al. | 15/141 R |
| 698,065 | 4/1902 | Sims | 15/141 R |
| 1,134,170 | 4/1915 | Washburn | 366/129 |
| 1,553,023 | 9/1925 | Bonnell | 15/142 X |
| 2,945,251 | 7/1960 | Eichner | 15/104.92 |

FOREIGN PATENT DOCUMENTS

| | | | |
|---|---|---|---|
| 371937 | 3/1907 | France | 15/141 R |
| 450237 | 4/1968 | Switzerland | 15/38 |

*Primary Examiner*—Edward L. Roberts
*Attorney, Agent, or Firm*—Morton J. Rosenberg

[57] ABSTRACT

A brush bristle cleaning system (10) which includes a handle member (16) adapted to be held in one hand of a user. The handle member (16) passes in a longitudinal direction (18). A first wire element (20) extends in an arcuate closed contour and is secured to the first handle member (16) on one end thereof. A first helical wire element (24) defining a plurality of first helical loops (26) pass around a portion of the closed contour of the first wire element (20). A second wire element (30) which extends in the longitudinal direction (18) is secured to the handle member (16) on a first end and is secured to the first wire element (20) on a second end thereof. A second helical wire element (36) passes around the second wire element (30) and defines a plurality of second helical loops (38). A brush (12) having brush bristles (14) is either longitudinally moved or transversely contacted with the helical loops of (38) and (26) to provide a cleansing action for the bristles of (14). A receptacle (44) is provided wherein the first wire elements (20) and second wire elements (30) may be releasably mounted for capturing a material being displaced from the brush bristles (14).

9 Claims, 2 Drawing Figures

BRUSH BRISTLE CLEANING SYSTEM

BACKGROUND OF THE INVENTION

1. Field of the Invention

This invention pertains to a brush bristle cleaning system for optimizing the use of a paint brush in subsequent painting operations. In particular, this invention relates to a cleaning system which is directed to remove a high percentage of paint or other material contained within brush bristles subsequent to a painting operation and to provide a set of bristles which are in non-contact relation each with respect to the other to allow flexing of the bristles. More in particular, this invention pertains to a brush bristle cleaning system which uses helically wound wire elements spaced apart each from the other in a manner wherein the bristles of the brush may contact the helical wire elements and pass therebetween. Further, this invention pertains to a cleaning system which may be easily and releasably mounted on a receptacle within which the material contained on the bristles are contained and captured.

2. Prior Art

Paint brush cleaning systems are known in the art. The best prior art known to the inventor includes U.S. Pat. Nos. 2,726,696; 3,430,286; 3,470,575; 2,737,945; 3,085,282; 3,147,501; and, 4,018,240.

Paint brush cleaning systems as shown in U.S. Pat. No. 3,430,286 are directed to systems having rollers within which a brush is inserted. The rollers are apparently displaced toward each other and the paint brush is squeezed therebetween. However, such types of paint brush cleaning systems do not separate the bristles since the rollers are continuous in nature.

Other types of cleaning systems such as that shown in U.S. Pat. No. 3,470,575 clean bristles for hair brushes. Such prior art systems are rotationally actuated and may in some cases be motor driven. In this type of system, fingers rotate and apparently cooperate with each other between the brush bristles to pick up debris which are secured to the brush or bristles. Such prior systems do provide for finger type elements but such are not adaptable to the helically wound elements as provided in the subject invention concept.

In other types of cleaning systems such as that shown in U.S. Pat. No. 2,737,945, such do include upper apex edges around which the brush or bristles are passed. Such apices do in some manner allow the displacement of the bristles with respect to each other. However, such do not provide for the flexing of helically wound elements which allow for the removal of the material contained within the bristles as is provided in the invention concept.

SUMMARY OF THE INVENTION

A brush bristle cleaning system which includes a handle member extending in a longitudinal direction. The system further includes a first wire element extending in an arcuate closed contour and such first wire element is secured to the handle member. The overall contour of the first wire element substantially defines a horizontal plane. A first helical wire element defining a plurality of first helical loops passes around the first wire element throughout a portion of the closed contour extension. Thus, the first wire element passes internal to the first helical wire element loops. A second wire element extending in the longitudinal direction is provided in the system with the second wire element secured to the handle member on a first end thereof. A second helical wire element defining a plurality of second helical loops passes around the second wire element; thus, the second wire element passes internal to the second helical wire element loops.

DESCRIPTION OF THE PREFERRED EMBODIMENTS

Figure 1:
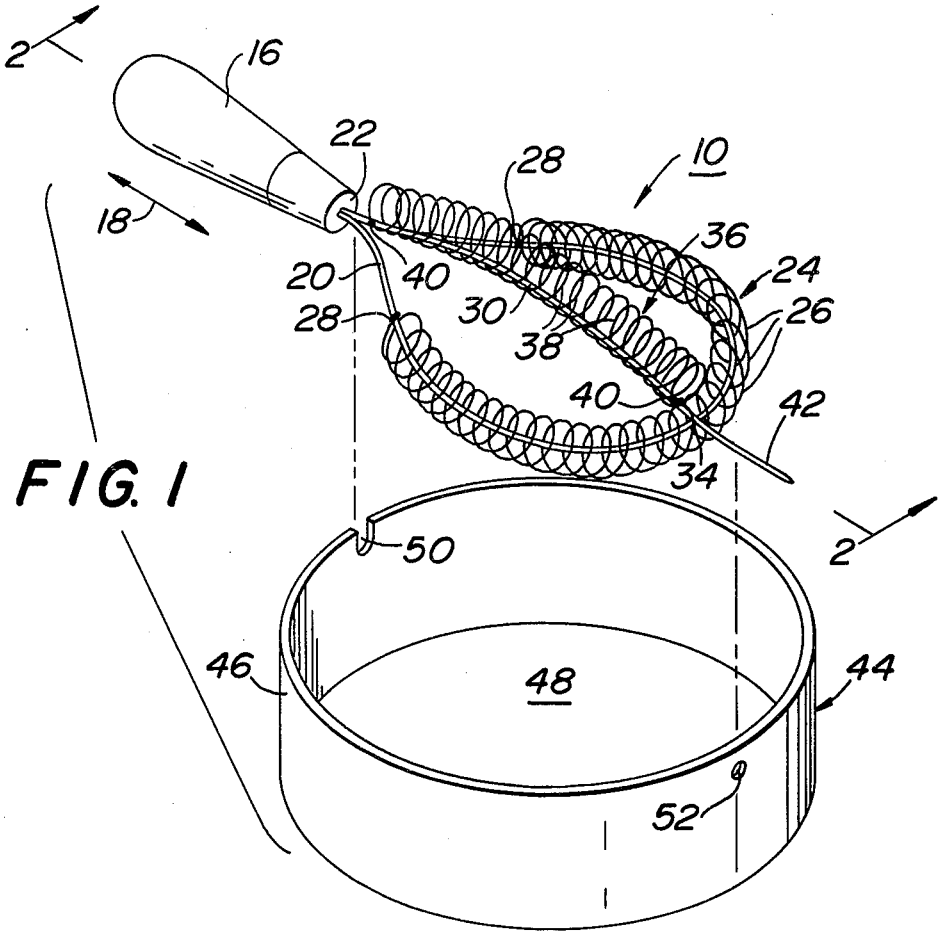
FIG. 1 is a perspective view of the brush bristle cleaning system.
Figure 2:
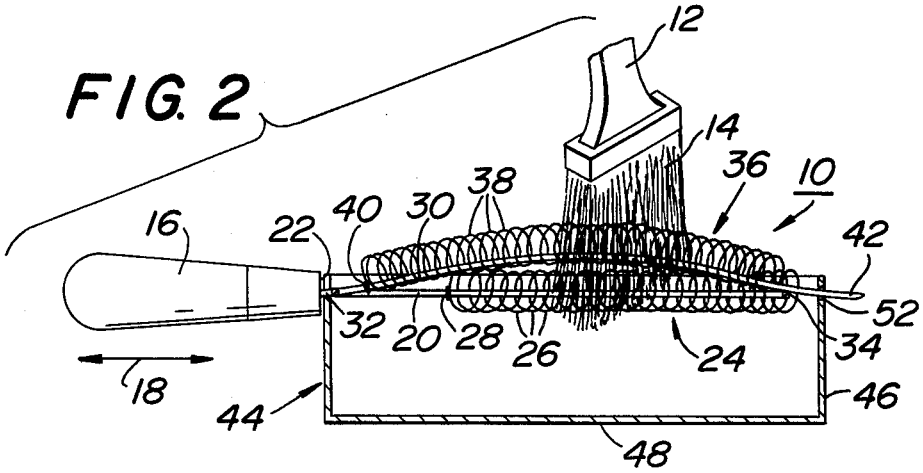
FIG. 2 is a cross-sectional view of the brush bristle cleaning system taken along the section line 2—2 of FIG. 1.

Referring now to FIGS. 1 and 2, there is shown a brush bristle cleaning system 10 for cleaning bristles 14 of brush 12 subsequent to a painting operation or some like use. In overall concept, cleaning system 10 is used for maintaining brush bristles 14 in a resilient and non-coupled relation each with respect to the other subsequent to a use application. As will be described in the following paragraphs, utilization of cleaning system 10 allows bristles 14 to be flexible and decoupled from adjacent bristles 14 and in a state of readiness for a next painting operation.

Brush bristles 14 have generally been cleaned subsequent to a painting operation by insertion into turpentine or some like paint solvent. However, when brush 12 is left within the aforementioned solvent for prolonged periods of time or in the alternative when paint brush 12 is removed from the solvent prior to a complete cleaning of bristles 14, bristles 14 have been found to become stiff and hardened as well as in coupled relation each to the other. This has had the effect of having the user reinsert brush 12 and bristles 14 into a subsequent solvent or container which increases the amount of time needed for a painting operation as well as possibly diluting the paint in a further painting operation due to the fact that solvent remains on bristles 14.

Brush bristle cleaning system 10 includes a handle member 16 which extends in longitudinal direction 18 as shown by the directional arrows in FIGS. 1 and 2. Handle member 16 may be formed of wood or some like material and is utilized as a grip or holding member for system 10 when such is operational and in contact with bristles 14 of brush 12 as is shown in FIG. 2. As is shown in the figures, handle member 16 may be cylindrical in overall contour. However, the handle contour is not important to the inventive concept as is described in the subject invention concept with the exception that handle member 16 should be of a size and dimension adaptable to be generally held in the hands of a user.

System 10 further includes first wire element 20 extending in an arcuate closed contour and is secured to handle member 16. First wire element 20 defines a horizontal plane as is shown in FIGS. 1 and 2. First wire element 20 is insertable within handle end section 22 as is shown in FIG. 1. Securement of first wire element 20 to handle member 16 may be through a force fit type of insert or adhesive bonding subsequent to insert of first wire element 20 or some like technique not important to the inventive concept as is herein described with the exception that first wire element 20 be rigidly secured to handle member 16. First wire element 20 may be formed of steel wire having a diameter approximating one-eighth of an inch. In overall concept, first wire element 20 may be formed of other types of metal such as aluminum, or other like metals having a diameter sufficient to provide structural integrity when system 10 is in use and being contacted by bristles 14.

First helical wire element 24 defines a plurality of first helical loops 26 as is shown. First wire element 20 is contoured and passes internal to first helical wire element loops 26. Spacing between adjacent loops 26 may be provided in the range of 0.25–0.75 inches with the objective being that bristles 14 pass within the spaces and contact helical loops 26 as is shown in FIG. 2.

First helical wire element 24 is fixedly secured to first wire element 20 on opposing ends of first helical wire element 24 through welding or some like technique. Welding section 28 is shown in FIGS. 1 and 2 to maintain first helical wire element 24 in general fixed securement to first wire element 20. In this manner, first helical wire element 24 is fixedly mounted on first wire element 20. However, there is flexural displacement of a plurality of first helical loops 26 when such is contacted by brush bristles 14. The flexural displacement of individual helical loops 26 allows for bristles 14 to be decoupled each from the other in an advantageous and optimized manner.

System 10 further includes second wire element 30 which extends generally in longitudinal direction 18. Second wire element 30 is secured to handle member 16 on first end 32 of second wire element 30. As is seen, second wire element 30 is insertable within handle end section 22 and may be secured thereto by a force fit similar in nature to that previously described for first wire element 20. Second wire element 30 may be formed of the same material and metallic composition as that provided for first wire element 20 and may include the same general dimensions as that previously described.

Second wire element 30 is fixedly secured to first wire element 20 in the area of second end 34 through welding or some like technique sufficient to maintain second wire element in fixed relation to first wire element 20. Additionally, as is clearly seen in FIG. 2, second wire element 30 is generally arcuately contoured and passes out of the horizontal plane defined by first wire element 20. In this manner, second wire element 30 passes either above or below first wire element 20 in order to provide an easier brushing action when bristles 14 are placed in contact with the various helical loops associated with second wire element 30 and first wire element 20.

Second helical wire element 36 defines a plurality of second helical loops 38. As can be seen, second wire element 30 passes internal to second helical loops 38. Additionally, second helical wire element 36 is fixedly secured to second wire element 20. Fixed securement is provided by opposing weld points 40 which still allows a flexural displacement of second helical loops 38 when contacted by brush bristles 14.

Second wire element 30 includes extended end section 42 passing in longitudinal direction 18. As can be seen, extended end section 42 passes beyond first wire element 20 in its closed contour. The use of extended end section 42 will be described in following paragraphs.

Cleaning system 10 further may include receptacle element 44 which is seen to be cup shaped in contour and includes sidewall 46 as well as base wall or floor 48. Receptacle element 44 may be formed of a metallic composition generally not important to the inventive concept as is herein described. However, receptacle element 44 should have a closed area within which paint or other material from bristles 14 may be captured.

Receptacle element 44 in combination with brush bristle cleaning system elements hereinbefore described provide for a releasable mounting of first and second wire elements 20 and 30 at least partially within receptacle element 44 for maintaining cleaning system 10 in fixed location when contacted by bristles 14 of brush 12. Additionally, receptacle element 44 may be cylindrical in contour or may be provided with a different contour shape with the only restriction being that such a contour provide a closed volume within which waste material may be contained and captured.

Sidewall 46 of receptacle element 44 includes notch opening 50 formed in receptacle sidewall 46. Additionally, through opening 52 is formed in receptacle sidewall 46. Notch 50 and through opening 52 are longitudinally aligned in longitudinal direction 18 as is shown in FIGS. 1 and 2. Notch 50 should have a width greater than the width dimension of first wire element 20 and second wire element 30. Additionally, through opening 52 should have a diameter slightly larger than extended end section 42 of second wire element 30.

In this manner, system 10 may be releasably mounted to receptacle element 44 by insertion of wire elements 20 and 30 within notch 50 and further insertion and passage therethrough of extended end section 42 through opening 52 as is shown in FIG. 2. Further, the entire system 10 may be rotatably displaced when mounted in notch 50 and through opening 52. In this manner, various angular displacements may be provided for contact of brush bristles 14 for ease of manipulation by the user and for a maximum effect in contacting bristles 14 with loops 26 and 38.

In use, brush 12 may be moved longitudinally along helical loops 38 and 26 to provide contact and removal of material contained within bristles 14. Additionally, bristles 14 may be moved transverse in longitudinal direction 18 to provide contact and spacing of individual bristles 14 each from the other in order to provide a flexible type of bristle for subsequent use. Subsequent to contact in the manner above described, bristles 14 are generally flexible in nature and in non-contact relation with adjacent bristles. This allows brush 12 to be utilizable in an expeditious fashion for the next or subsequent painting operation.

Although this invention has been described in connection with specific forms and embodiments thereof, it will be appreciated that various modifications other than those discussed above may be resorted to without departing from the spirit of scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A brush bristle cleaning system including:

(a) a handle member extending in a longitudinal direction;

(b) a first wire element extending in an arcuate closed contour being secured to said handle member, said first wire element substantially defining a horizontal plane;

(c) a first helical wire element defining a plurality of first helical loops, said first wire element passing internal to said first helical wire element loops;

(d) a second wire element extending in said longitudinal direction, said second wire element being secured to said handle member on a first end thereof, said second wire element being fixedly secured to said first wire element on a second end thereof; and, (e) a second helical wire element defining a plurality of second helical loops, said second wire element passing internal to said second helical wire element loops.

2. The brush bristle cleaning system as recited in claim 1 where said first and second helical wire elements are fixedly secured to said first and second wire elements respectively.

3. The brush bristle cleaning system as recited in claim 2 where said first and second helical wire elements are fixedly secured to said first and second wire elements on opposing ends of said first and second helical wire elements for providing flexural displacement of a plurality of said first and second helical wire elements when contacted by said brush bristles.

4. The brush bristle cleaning system as recited in claim 1 where said second wire element is arcuately contoured and passes out of said horizontal plane defined by said first wire element.

5. The brush bristle cleaning system as recited in claim 1 where said second wire element extends beyond said first wire element contour in said longitudinal direction.

6. The brush bristle cleaning system as recited in claim 5 including a receptacle element being cup shaped in contour and having a sidewall.

7. The brush bristle cleaning system as recited in claim 6 including means for releasably mounting said first and second wire elements at least partially within said receptacle element for maintaining said cleaning system in fixed location when contacted by said brush.

8. The brush bristle cleaning system as recited in claim 7 where said releasable mounting means includes:

(a) a notch formed in said receptacle sidewall;

(b) a through opening formed in said receptacle sidewall, said notch and through opening being longitudinally aligned.

9. The brush bristle cleaning system as recited in claim 8 wherein said first and second wire elements are rotatably displaceable when mounted in said notch and through opening.

* * * * *